United States Patent [19]

Johnson

[11] 4,438,305

[45] Mar. 20, 1984

[54] FIRE RESISTANT PRESSURE SWITCH

[75] Inventor: James R. Johnson, Johnson County, Kans.

[73] Assignee: Sor, Inc., Olathe, Kans.

[21] Appl. No.: 310,783

[22] Filed: Oct. 13, 1981

[51] Int. Cl.[3] ..... H01H 35/40

[52] U.S. Cl. ..... 200/83 J; 200/82 C; 200/302.1

[58] Field of Search ..... 200/2, 82 R, 82 C, 83 R, 200/83 B, 83 J, 83 S, 83 SA; 307/118

[56] References Cited

U.S. PATENT DOCUMENTS

| | | | |
|---|---|---|---|
| 2,117,213 | 5/1938 | Rodanet | 200/83 J |
| 3,444,341 | 5/1969 | Mighton | 200/83 J |
| 3,584,168 | 6/1971 | Halpert | 200/83 S |
| 3,937,912 | 2/1976 | Martin | 200/82 C |

FOREIGN PATENT DOCUMENTS

| | | | |
|---|---|---|---|
| 328811 | 5/1930 | United Kingdom | 200/83 J |

*Primary Examiner*—G. P. Tolin

*Attorney, Agent, or Firm*—Kokjer, Kircher, Bradley, Wharton, Bowman & Johnson

[57] ABSTRACT

A pressure switch device having a fire resistant welded assembly of corrosion resistant steel components exposed to the fluid medium which is being monitored. A flexible diaphragm constructed of corrosion resistant steel film is overlaid by a backing disc and backing ring both formed of corrosion resistant steel. Inside the backing ring is an elastomer disc which receives a stainless steel piston that moves up and down in response to changes in the fluid pressure applied to the diaphragm through a pressure port. The piston has a shaft which actuates an electrical switch in response to changes in the pressure of the fluid medium. The periphery of the diaphragm is secured by a pressure tight weld to the housing, the upper corrosion resistant steel disc and the backing ring to provide a fire resistant assembly which confines the pressure medium in the event of a fire.

3 Claims, 3 Drawing Figures

FIRE RESISTANT PRESSURE SWITCH

BACKGROUND AND SUMMARY OF THE INVENTION

This invention relates to pressure operated switches and more particularly to a switch that is resistant to fire.

Pressure switches are widely used to monitor the pressure conditions of various types of fluid systems. For example, it is common to equip fluid systems with pressure responsive electrical switches that are actuated in the event of an undue change in the fluid pressure. Although switches of this type function well for the most part, they are not suited for high temperature service or use in environments which may be exposed to the possibility of fire. Typically, the pressure sensing function is performed by a force balanced piston assembly that is sealed from the fluid medium by a flexible diaphragm and a conventional O-ring. When exposed to high temperatures such as occur during a fire, these and associated components of the switch either burn or melt, and the fluid medium can escape to the surrounding area through the damaged switch device. If the fluid medium is toxic or flammable, its release can lead to serious adverse consequences.

Accordingly, it is the primary object of the present invention to provide a pressure responsive switch that is constructed in a manner to contain the fluid medium even under fire conditions when less heat resistant components have burned or melted. In accordance with the invention, the diaphragm which is directly exposed to the fluid medium is constructed of corrosion resistant steel film and is backed by an elastomer disc and an annular backing ring which is also formed of corrosion resistant steel. The diaphragm is welded to the housing of the unit and to the backing ring by a pressure tight weld. The result is that the fluid medium is contained by a welded assembly of corrosion resistant steel components that does not break down even when subjected to the high temperatures that occur during a fire.

DETAILED DESCRIPTION OF THE INVENTION

In the accompanying drawing which forms a part of the specification and is to be read in conjunction therewith and in which like reference numerals are used to indicate like parts in the various views.

Figures 1, 2:
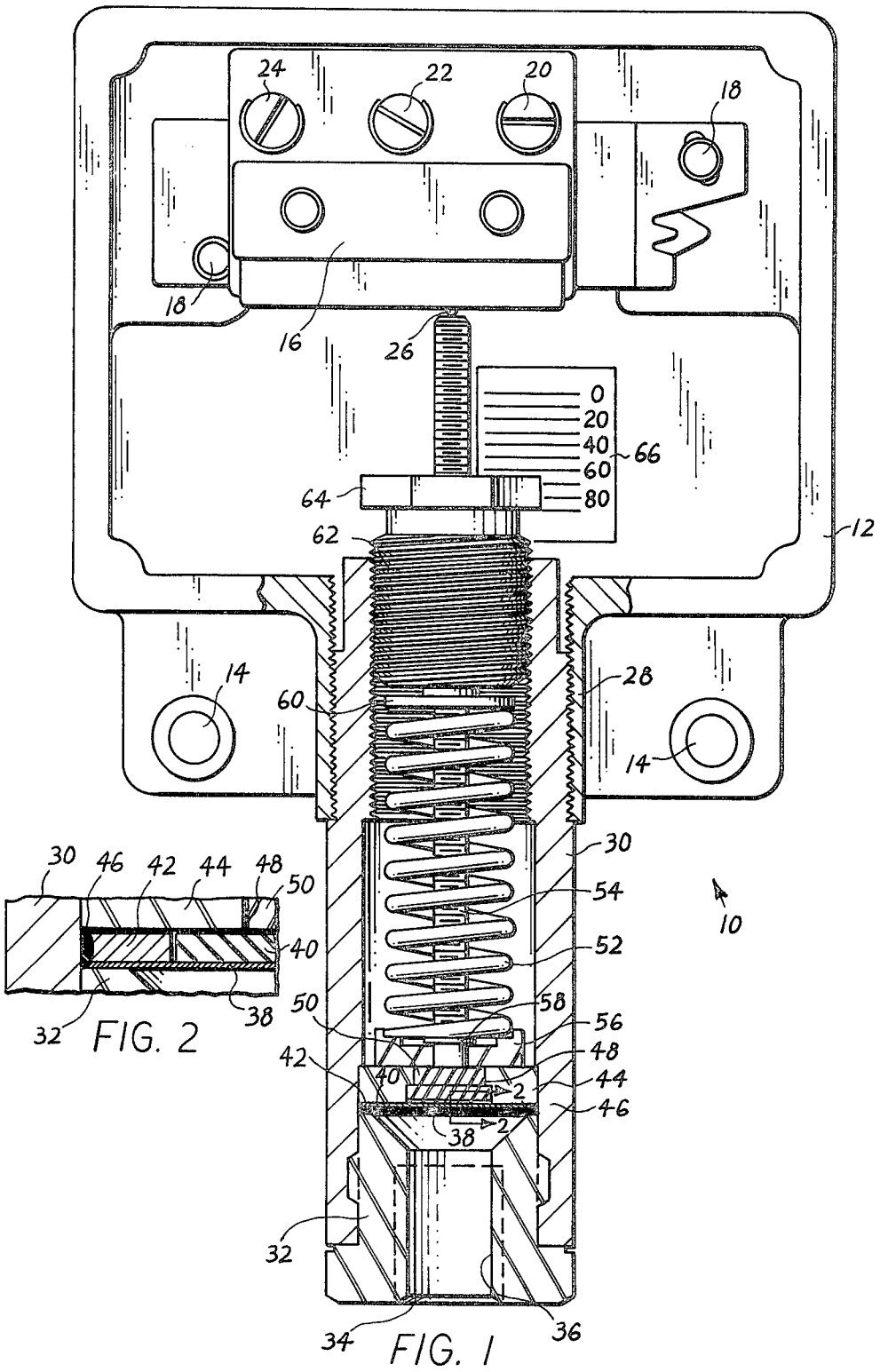
FIG. 1 is a sectional view of a fire resistant pressure switch constructed according to a preferred embodiment of the present invention.
FIG. 2 is a fragmentary sectional view on an enlarged scale taken generally along line 2—2 of FIG. 1 in the direction of the arrows.

Referring now to the drawing in more detail, numeral 10 generally designates a pressure responsive switch device constructed in accordance with a preferred embodiment of the present invention. The switch device 10 has a generally rectangular or round housing 12. The housing 12 includes bolt holes 14 and contains one or more electrical switch element assemblies 6 which are fastened to the housing by screws 18. The switch element 16 includes a common switch terminal 20, a normally open terminal 22 and a normally closed terminal 24. A plunger 26 is urged downwardly out of the switch element by an internal spring (not shown) such that the common terminal 20 and the normally closed terminal 24 are electrically connected when the plunger is in its normally extended position. When plunger 26 is depressed, the common terminal 20 is electrically connected with the normally open terminal 22. Suitable wiring (not shown) connects the switch terminals with equipment controlled by the switch.

An integral neck portion 28 of the switch housing is internally threaded in order to receive the externally threaded upper end of a sleeve 30. Threaded into the lower end of sleeve 30 is a pressure port fitting 32 having a hex head for conveniently receiving a wrench. A pressure port 34 is formed centrally in fitting 32 and connects with an internally threaded passage 36. The internal threads in passage 36 permit connection with a fluid system in order to apply the pressure of the fluid medium to port 34.

Figure 3:
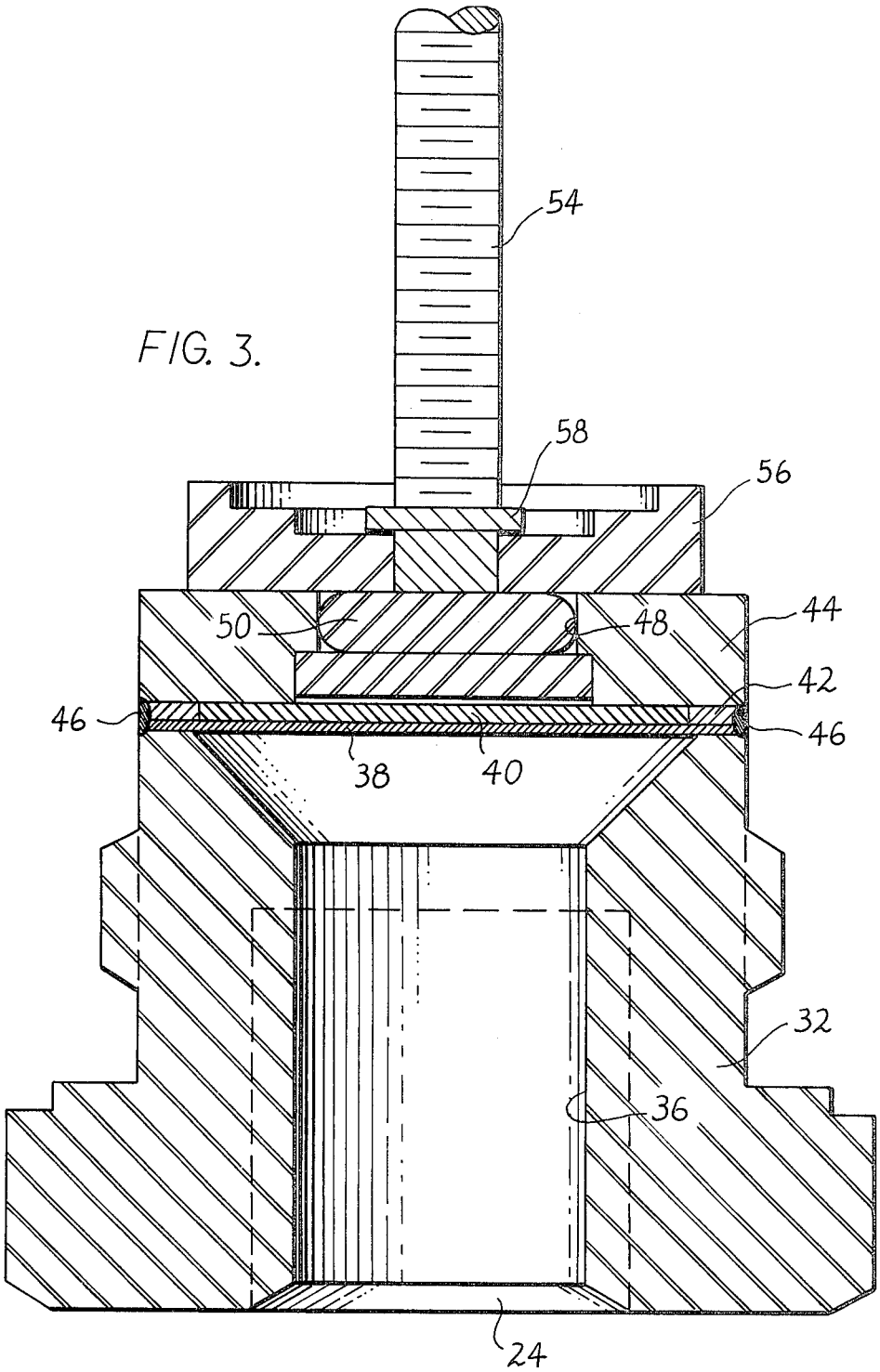
FIG. 3 is an enlarged sectional view of the welded assembly of fire resistant components which are secured together in a single unit to confine the fluid pressure applied to the switch.

Referring now particularly to FIGS. 2 and 3, the upper end of passage 36 is sealed by a flexible diaphragm 38 which is constructed of stainless steel film or another fire resistant material. A thin elastomeric backing disc 40 overlays the central portion of diaphragm 38 and is surrounded by an annular backing ring 42 which extends closely around the periphery of disc 40. The backing ring 42 overlays the peripheral area of diaphragm 38, and ring 42 is preferably constructed of stainless steel or a similar fire resistant material.

The peripheries of diaphragm 38 and backing ring 42 are secured to one another and to fitting 32 and an upper corrosion resistant steel disc 44 by a pressure tight weld 46. Preferably a stainless steel is used, but other corrosion resistant alloys can also serve. The weld 46 extends completely around the peripheral regions of the diaphragm and back up ring and provides a fluid tight seal which prevents the fluid medium in pressure port 34 from leaking past the diaphragm. The fluid medium is thus confined to the area below the diaphragm 38. Backing disc 40 is movable within ring 42.

The upper disc 44 engages an internal shoulder formed within sleeve 30 and is prevented by the shoulder from moving upwardly. A stepped bore 48 is formed centrally through disc 44 and receives a stainless steel piston 50. The piston 50 can move upwardly and downwardly in limited fashion within bore 48, and the lower surface of the piston engages the upper surface of the backing disc 40. Upward movement of piston 50 is limited by engagement of the piston with an internal shoulder formed within the stepped bore 48. The pressure tight weld 46 secures all of the components shown in FIG. 3 permanently together in a single unit. Thus, ring 42 and diaphragm 38 are welded to one another and to fitting 32 and disc 44 with disc 40 sandwiched between piston 50 and the diaphragm 38.

The piston 50 is continuously urged downwardly by a range spring 52 which is coiled around a shaft 54 extending upwardly from the piston. The lower end of the range spring 52 engages a spring retainer 56 and a collar 58 attached to the lower end portion of shaft 54. The upper end of spring 52 engages a flange 60 extending from an adjustment nut 62 which is threaded into the internally threaded upper portion of sleeve 30. The adjustment nut 62 has a hex head 64 and may be threaded into and out of sleeve 30 in order to vary the force exerted by the range spring 52. Engagement of collar 58 with the spring retainer 56 limits downward movement of the piston assembly.

Shaft 54 extends slidably through the adjustment nut 62. The top end of the shaft is located adjacent the plunger 26 and depresses the plunger when piston 50 is moved upwardly to its limiting position. The head 64 of adjustment nut 62 cooperates with a calibration scale 66 to provide on indication of the fluid pressure necessary to maintain plunger 26 in a depressed condition.

In operation, the switch device 10 serves to monitor the pressure of the fluid medium which is applied to the pressure port 34. The pressure of the fluid medium is applied through pressure port 34 and passage 36 to the lower surface of diaphragm 38. The force exerted against the diaphragm is transmitted to the movable backing disc 40 which acts against piston 50 to push the piston upwardly to its limiting position when the fluid pressure is sufficient to overcome the countering force applied by the range spring 52. So long as the fluid pressure is sufficiently high to overcome the force of the range spring, piston 50 is maintained in its upper position, and the shaft 54 maintains plunger 26 in a depressed condition to maintain electrical connection between the common terminal 20 and the normally open terminal 22 of the switch element 16.

When the fluid pressure applied to pressure port 34 drops below a preselected level determined by the position of adjustment nut 62, the force of spring 54 moves piston 50 downwardly until the spring retainer 56 engages the adjacent surface of the disc 44 to limit downward movement of the piston. In this position of the piston, shaft 54 releases plunger 26, and the plunger moves to its extended position wherein the common terminal 20 is electrically connected with the normally closed terminal 24. The switch then activates appropriate equipment or provides an indication that the pressure of the fluid medium has dropped. The fluid pressure required to maintain piston 50 in its upper position can be adjusted by turning the adjustment nut 62, and the reading provided on scale 66 gives an indication of the set pressure level.

The self-contained welded corrosion resistant steel assembly shown in FIG. 3 is exposed to the fluid medium and seals the portion of the housing above diaphragm 38 to confine the fluid medium to the area below the diaphragm. In the event of high temperatures such as are encountered during fire conditions, the corrosion resistant steel pressure port fitting 32, diaphragm 38, backing ring 42, holding disc 44 and piston 50 do not melt, burn or otherwise break down, and the fluid medium applied to port 34 is unable to leak to the surrounding area through the switch device 10. The assembly shown in FIG. 3 can be removed and replaced if necessary by threading fitting 32 out of sleeve 30.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A fire resistant switch device responsive to the pressure of a fluid medium, said device comprising:

a housing having a tubular end for connection with the fluid medium;

a pressure responsive piston in said housing supported for movement therein between first and second positions;

a switch element;

actuating means for effecting a first condition of said element when said piston is in said first position and a second condition of the switch element when said piston is in said second position;

yieldable means for urging said piston toward said first position;

a metal fitting insertable in the said end of said housing, said fitting located on the opposite side of said piston from said switch, said fitting including (a) a pressure port therethrough for communication with the fluid medium, said port having opposite ends including an inlet end for the fluid medium, (b) a flexible metal diaphragm overlying the end of said port opposite the inlet end and having its periphery generally coincident with the periphery of the fitting, (c) a metal ring member overlying said diaphragm and having its periphery generally coincident with the periphery of said diaphragm, (d) the adjoining peripheries of said fitting, diaphragm and ring member all being joined together by a continuous weld seam providing a pressure tight connection sealing off the housing from the fluid medium which will remain effective in the event of high temperature destruction of other components of the device, (e) a movable disk assembly within said ring member and disposed to respond to movement of said diaphragm caused by pressure changes in the medium and operable to move said piston in response to movement of said diaphragm thereby to actuate said piston between said first and second positions.

2. A fire resistant switch device as in claim 1 wherein, said fitting includes a metal disk adjacent said ring member on the side opposite the diaphragm said disk having a bore for reception of at least a portion of said movable disk assembly, said disk having a periphery generally coincident with the periphery of the ring member and fused to the ring member by said weld.

3. A fire resistant switch device as in claim 1, wherein, said weld seam has its body slightly inset into the ring and diaphragm thereby to have substantially the same outside dimension as the fitting.

* * * * *